US011618251B2

(12) United States Patent
Hayashi et al.

(10) Patent No.: US 11,618,251 B2
(45) Date of Patent: Apr. 4, 2023

(54) LIQUID EJECTION APPARATUS

(71) Applicant: Brother Kogyo Kabushiki Kaisha, Aichi-Ken (JP)

(72) Inventors: Masayoshi Hayashi, Nagoya (JP); Isao Kubo, Tokoname (JP); Yuta Toda, Nagoya (JP); Ryuji Horata, Gamagori (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 108 days.

(21) Appl. No.: 17/216,252

(22) Filed: Mar. 29, 2021

(65) Prior Publication Data

US 2021/0300022 A1 Sep. 30, 2021

(30) Foreign Application Priority Data

Mar. 31, 2020 (JP) ..... JP2020-064161

(51) Int. Cl.
*B41J 2/045* (2006.01)
*B41J 2/165* (2006.01)

(52) U.S. Cl.
CPC ..... *B41J 2/0451* (2013.01); *B41J 2/04555* (2013.01); *B41J 2/165* (2013.01); *B41J 2/16579* (2013.01)

(58) Field of Classification Search
CPC ..... B41J 2/0451; B41J 2/04555; B41J 2/165; B41J 2/16579
See application file for complete search history.

(56) References Cited

U.S. PATENT DOCUMENTS

| | | | | |
|---|---|---|---|---|
| 9,533,496 | B2 | 1/2017 | Takeuchi et al. | |
| 2007/0188538 | A1* | 8/2007 | Izuo | B41J 25/308 347/19 |
| 2016/0257113 | A1 | 9/2016 | Takeuchi et al. | |
| 2017/0182767 | A1* | 6/2017 | Smith | B41J 2/185 |
| 2019/0324094 | A1* | 10/2019 | Kosugi | H02J 7/0029 |
| 2021/0300030 | A1* | 9/2021 | Kubo | B41J 2/04555 |

FOREIGN PATENT DOCUMENTS

| | | | | |
|---|---|---|---|---|
| EP | 3228458 | A1 * | 10/2017 | B41J 2/01 |
| JP | 2007-098642 | A | 4/2007 | |
| JP | 2007-112086 | A | 5/2007 | |
| JP | 2010-058406 | A | 3/2010 | |
| JP | 2011-000798 | A | 1/2011 | |
| JP | 2016-159503 | A | 9/2016 | |

* cited by examiner

*Primary Examiner* — Sharon Polk
(74) *Attorney, Agent, or Firm* — Banner & Witcoff, Ltd.

(57) ABSTRACT

A liquid ejection apparatus includes a controller configured to perform: causing a voltage application circuit to apply a voltage between a liquid ejection head having a plurality of nozzles and an electrode; driving the liquid ejection head for causing a certain nozzle to eject liquid toward a cap in a state where the plurality of nozzles face the cap; receiving a signal from a signal output circuit; determining, based on the received signal, whether the certain nozzle has ejected liquid normally; determining, based on the received signal, whether a leakage current has occurred between the certain nozzle and the electrode; and specifying the certain nozzle as a leakage nozzle if the leakage current has occurred between the certain nozzle and the electrode.

11 Claims, 12 Drawing Sheets

LIQUID EJECTION APPARATUS

CROSS-REFERENCE TO RELATED APPLICATION

This application claims priority from Japanese Patent Application No. 2020-064161 filed on Mar. 31, 2020, the content of which is incorporated herein by reference in its entirety.

TECHNICAL FIELD

Aspects of the disclosure relate to a liquid ejection apparatus that ejects liquid from nozzles.

BACKGROUND

Examples of a liquid ejection apparatus that ejects liquid from nozzles include an inkjet printer that records images by ejecting ink from nozzles. The inkjet printer includes a print head with nozzles, an inspection box accommodating an electrode, a voltage application circuit connectable to the electrode, and a controller. The print head is disposed with the nozzles facing the inspection box. The print head and the electrode are subjected to voltage from the voltage application circuit. In response to driving the print head to eject ink from a nozzle toward the electrode, the controller determines whether ink is normally ejected from a nozzle based on a signal outputted from the electrode. Before determining whether ink is normally ejected from a nozzle, the controller determines whether a leakage occurs between the print head and an ink receiving area near the electrode based on whether an actual measured voltage that the voltage application circuit applies between the print head and the electrode falls below a normal voltage range.

SUMMARY

Aspects of the disclosure provide a liquid ejection apparatus configured to identify a nozzle where a leakage current may occur.

According to one or more aspects of the disclosure, a liquid ejection apparatus includes: a liquid ejection head having a plurality of nozzles; a cap configured to cover the plurality of nozzles; an electrode accommodated in the cap; a voltage application circuit configured to apply voltage between the liquid ejection head and the electrode; a signal output circuit connected to the electrode and configured to output a signal indicating a potential of the electrode; and a controller configured to perform: causing the voltage application circuit to apply the voltage; driving the liquid ejection head for causing a certain nozzle to eject liquid toward the cap in a state where the plurality of nozzles face the cap; receiving the signal from the signal output circuit; determining, based on the received signal, whether the certain nozzle has ejected liquid normally; determining, based on the received signal, whether a leakage current has occurred between the certain nozzle and the electrode; and specifying the certain nozzle as a leakage nozzle if the leakage current has occurred between the certain nozzle and the electrode.

According to the one or more aspects of the disclosure, the controller can identify a nozzle where a leakage current may occur based on a result of the ejection determination.

DETAILED DESCRIPTION

Hereinafter, an illustrative embodiment will be described with reference to the accompanying drawings.

General Configuration of Printer

Figure 1:
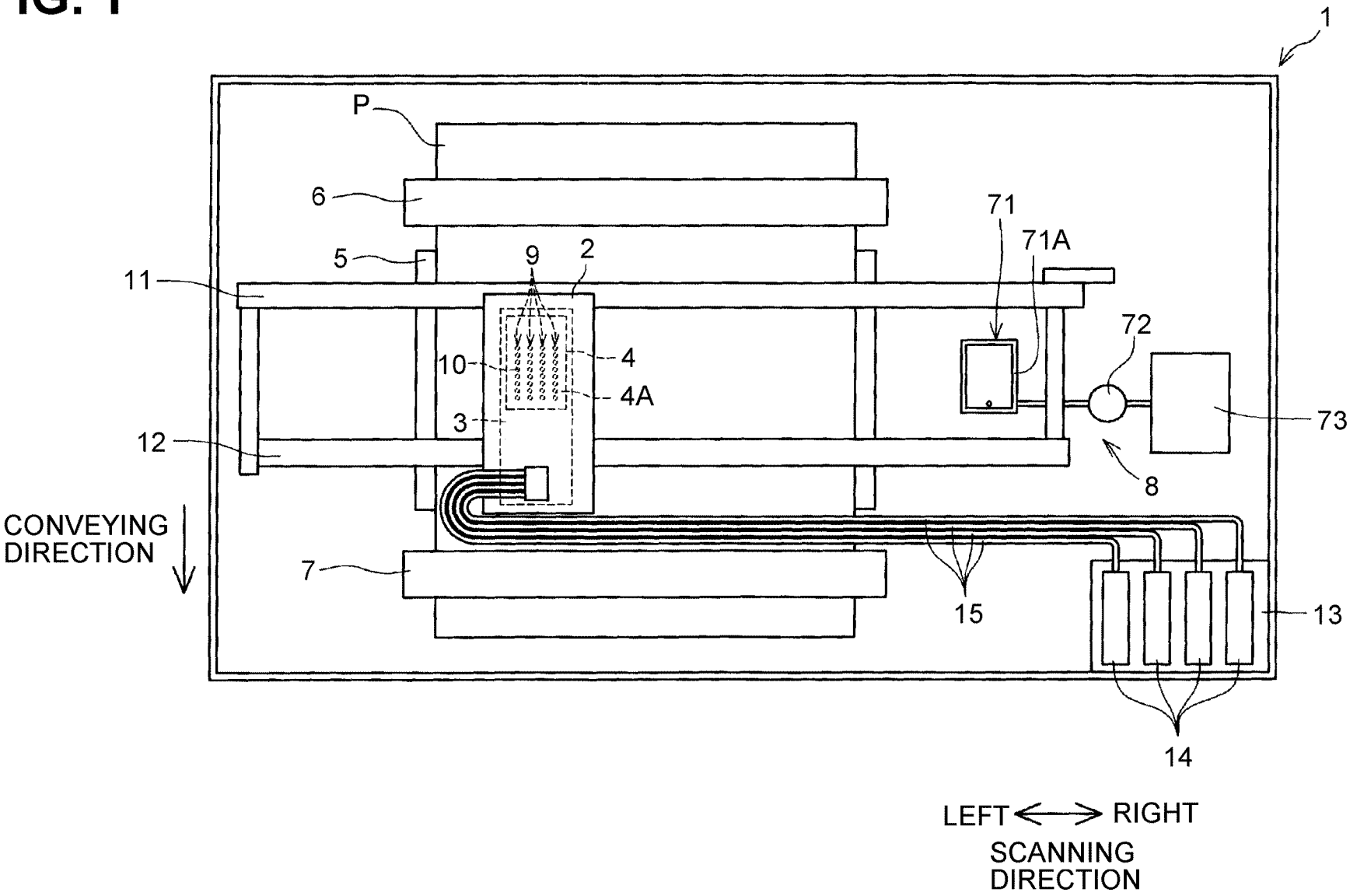
FIG. 1 is a schematic diagram illustrating a general configuration of a printer according to an illustrative embodiment of the disclosure.

As illustrated in FIG. 1, a printer 1 (as an example of a liquid ejection apparatus) includes a carriage 2, a sub tank 3, an inkjet head 4 (as an example of a liquid ejection head), a platen 5, conveyance rollers 6 and 7, and a maintenance unit 8.

The carriage 2 is supported by two guide rails 11 and 12 each extending in a scanning direction (e.g., a right-left direction). The carriage 2 is configured to reciprocate in the scanning direction along the guide rails 11 and 12. The scanning direction corresponds to a right-left direction as illustrated in FIG. 1.

The sub tank 3 is mounted on the carriage 2. The printer 1 further includes a cartridge holder 13. The cartridge holder 13 accommodates a plurality of, for example, four, ink cartridges 14 that are detachable. The four ink cartridges 14 arranged in the scanning direction store ink (as an example of liquid) of different colors, from right to left, black, yellow, cyan, and magenta, respectively. The sub tank 3 is connected via four tubes 15 to the four ink cartridges 14 attached to the cartridge holder 13. Such a configuration thus enables supply of ink of the four colors to the sub tank 3 from the four ink cartridges 14.

The inkjet head 4 is mounted on the carriage 2 and connected to a lower end of the sub tank 3. The inkjet head 4 is supplied with ink of the four colors from the sub tank 3.

The inkjet head 4 has an array of nozzles 10 defined in a nozzle surface 4A that is its lower surface. The inkjet head 4 is configured to eject ink from the nozzles 10. Specifically, for example, the nozzles 10 are arranged in rows extending in a conveyance direction orthogonal to the scanning direction to form nozzle rows 9. The inkjet head 4 includes a plurality of, for example, four, nozzle rows 9 next to each other in the scanning direction. In the inkjet head 4, black ink is ejected from the nozzles 10 included in the rightmost nozzle row 9 in the scanning direction. Yellow ink is ejected from the nozzles 10 included in the nozzle row 9 to the left of the black nozzle row 9. Cyan ink is ejected from the nozzles 10 included in the nozzle row 9 to the left of the yellow nozzle row 9. Magenta ink is ejected from the nozzles 10 included in the nozzle row 9 to the left of the cyan nozzle row 9.

The platen 5 is disposed below the inkjet head 4 and faces the nozzles 10. The platen 5 extends in the scanning direction to have a dimension covering the entire width of a recording sheet P to be conveyed. The platen 5 is configured to support from below a recording sheet P being conveyed. The conveyance roller 6 is disposed upstream of the inkjet head 4 and the platen 5 in the conveyance direction. The conveyance roller 7 is disposed downstream of the inkjet head 4 and the platen 5 in the conveyance direction.

The maintenance unit 8 includes a cap 71, a suction pump 72, and a waste liquid tank 73. The cap 71 is disposed to the right of the platen 5 in the scanning direction. The cap 71 has a rectangular planar shape. The cap 71 has a lip portion 71A protruding upward or toward the inkjet head 4 around an outer edge of the cap 71. When the carriage 2 is located in a maintenance position, the nozzles 10 face the cap 71. The maintenance position is further to the right than the platen 5 in the scanning direction.

The carriage 2 is moved to stop at the maintenance position so that the nozzles 10 and the cap 71 face each other. In such a state, in response to the cap 71 being moved upward by the cap up-and-down mechanism 88, the lip portion 71A of the cap 71 intimately contacts the nozzle surface 4A of the inkjet head 4 to cover the nozzles 10. At this time, the cap 71 that covers the nozzles 10 is in a capping state, and the nozzles 10 capped by the cap 71 are in a capped state. The cap 71 is not limited to have such a configuration that the lip portion 71A intimately contacts the nozzle surface 4*a* to cover the nozzles 10. The cap 71 may be structured such that that the lip portion 71A intimately contacts a frame surrounding the nozzle surface 4A of the inkjet head 4 to cover the nozzles 10. In this embodiment, a combination of the carriage 2 and the cap up-and-down mechanism 88 is an example of a relative movement device.

The suction pump 72 may be a tube pump. The suction pump 72 is connected to the cap 71 and the waste liquid tank 73. The maintenance unit 8 uses the suction pump 72 to perform a suction purge in which, in response to driving of the suction pump 72 in a state where the nozzles 10 are in the capped state, ink in the inkjet head 4 is pumped out or discharged from the nozzles 10. Ink discharged from the inkjet head 4 by the suction purge is collected in the waste liquid tank 73.

For the sake of convenience, in this embodiment, the cap 71 covers all the nozzles 10 of the inkjet head 4 and the suction purge is performed to discharge ink in the inkjet head 4 from all the nozzles 10. In some embodiments, the maintenance unit 8 may include a plurality of caps 71, one for covering the nozzles 10 included in the rightmost nozzle row 9 from which black ink is discharged, and the other for covering the nozzles 10 included in the remaining three nozzle rows 9 from which respective color inks (e.g., yellow, cyan, and magenta inks) are discharged. Such a configuration may enable the suction purge to discharge black ink or color inks selectively in the inkjet head 4. Alternatively, for example, the maintenance unit 8 may include a plurality of caps 71 for respective nozzle rows 9. Such a configuration may enable ink to be discharged from the nozzles 10 of the inkjet head 4 on a nozzle row 9 basis.

Figure 2:
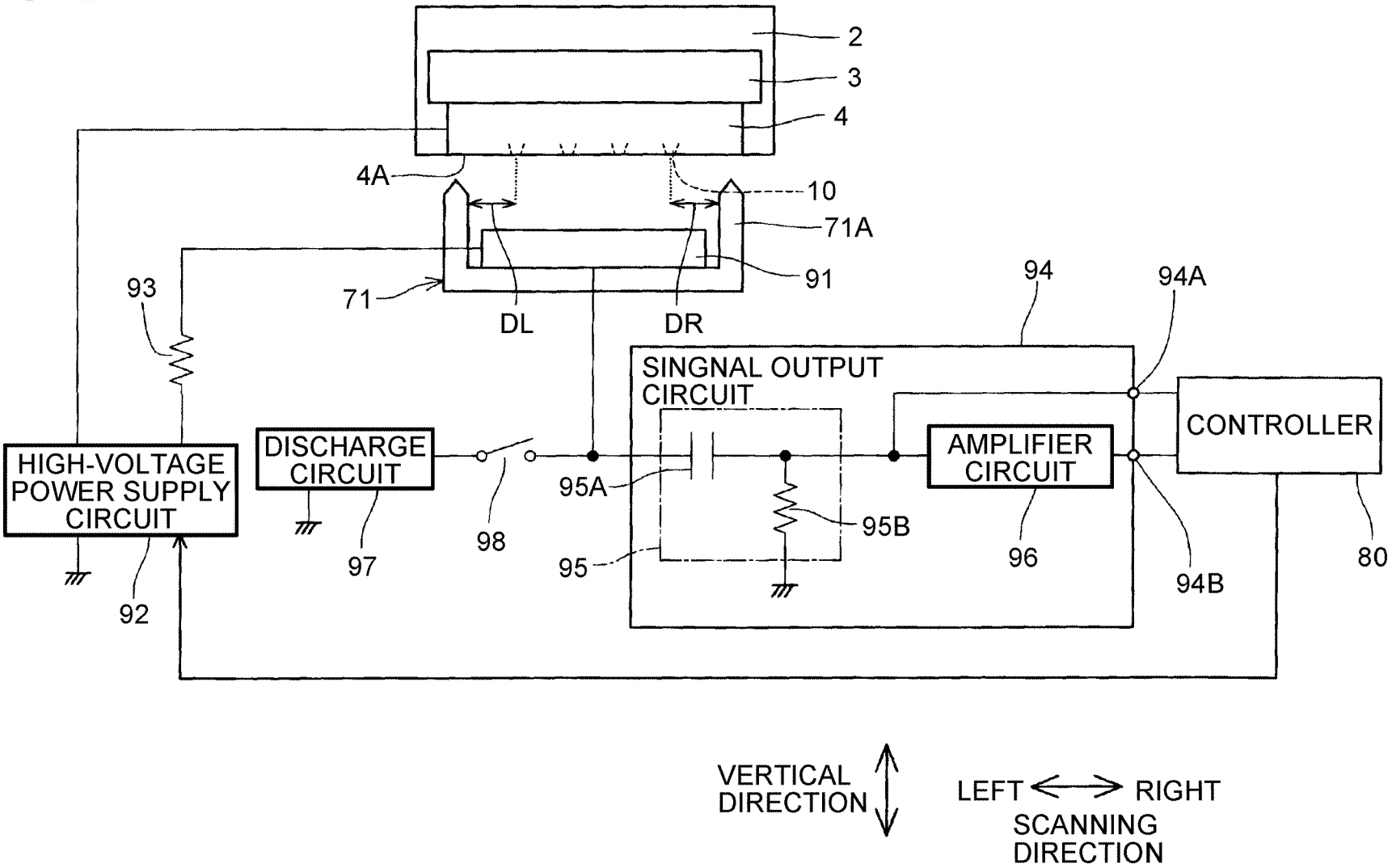
FIG. 2 is a schematic diagram illustrating a detection electrode disposed in a cap, a connection relationship between the detection electrode, a high-voltage power supply circuit, an output signal circuit, and a controller.

As illustrated in FIG. 2, a detection electrode 91 having a rectangular planar shape is disposed within the cap 71. The detection electrode 91 is connected to a high-voltage power supply circuit 92 (as an example of a voltage applying circuit) via a resistor 93. The high-voltage power supply circuit 92 is connected to a conductive portion of the inkjet head 4. The conductive portion is defined by plates 32 to 35 of the inkjet head 4 that are made of a conductive material. The conductive portion of the inkjet head 4 is connected to a ground terminal of the high-voltage power supply circuit 92, and maintained at ground potential. The detection electrode 91 receives an electric potential or voltage from the high-voltage power supply circuit 92. Thus, the high-voltage power supply circuit 92 applies voltage between the detection electrode 91 and the conductive portion of the inkjet head 4.

The detection electrode 91 is connected to a signal output circuit 94. The signal output circuit 94 includes a filter circuit 95 and an amplifier circuit 96. The filter circuit 95 is connected to the detection electrode 91. The filter circuit 95 has a capacitor 95A and a resistor 95B, and removes a high-voltage DC component applied by the high-voltage power supply circuit 92 from the potential of the detection electrode 91. A signal corresponding to which the filter circuit 95 has removed the high-voltage DC component from the potential of the detection electrode 91 is outputted from an output 94A of the signal output circuit 94.

The filter circuit 95 is connected to the amplifier circuit 96. The amplifier circuit 96 amplifies the signal of which the high-voltage DC component has been removed from the potential of the detection electrode 91 by the filter circuit 95. The signal amplified by the amplifier circuit 96 is outputted from an output 94B of the signal output circuit 94.

In an ejection determination described later in this embodiment, the high-voltage power supply circuit 92 applies voltage (e.g., approximately 300 v) between the detection electrode 91 and the conductive portion of the inkjet head 4 by maintaining the conductive portion at the ground potential and applying a predetermined positive potential (e.g., approximately 300 v) to the detection electrode 91, in order to drive the inkjet head 4 to eject ink droplets from the nozzles 10.

In a case where ink is ejected from a nozzle 10, ink becomes electrically charged by the potential difference between the detection electrode 91 and the conductive portion of the inkjet head 4. Until the charged ink approaches and reaches the detection electrode 91, the potential of the detection electrode 91 rises from a potential at which the inkjet head 4 is not driven. After the charged ink reaches the detection electrode 91, the potential of the detection electrode 91 gradually lowers to the potential thereof at which the inkjet head 4 is not driven. In other words, the potential of the detection electrode 91 changes in a driving period TD during which the inkjet head 4 is driven.

Figure 3A:
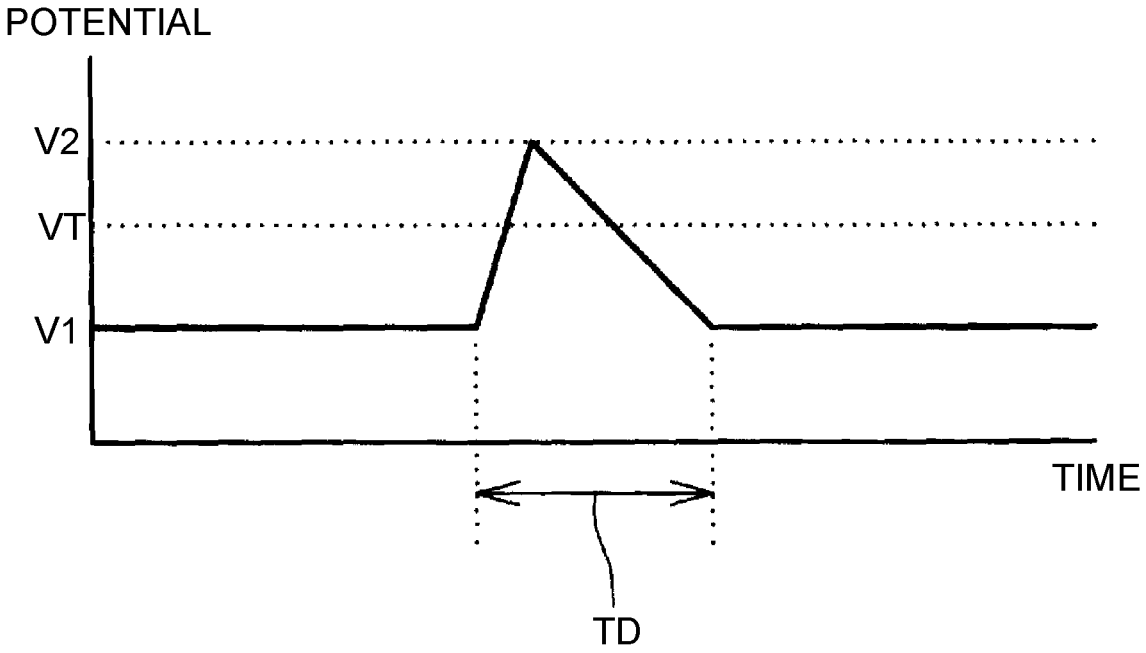
FIG. 3A is a graph showing changes in potential of the detection electrode in a case where ink has been ejected from a nozzle.

However, the change in the potential of the detection electrode 91 is not so large at this time. As described above, the signal output circuit 94 is structured such that the potential of the detection electrode 91 from which the high-voltage DC component has been removed at the filter circuit 95 is amplified at the amplifier circuit 96 and then outputted from the output 94B. As illustrated in FIG. 3A, in the driving period TD of the ink-jet head 4, the potential outputted from the output 94B rises from a potential V1 at which the inkjet head 4 is not driven, reaches a potential V2, which is higher than the potential V1, and then gradually lowers to the potential V1.

Figure 3B:
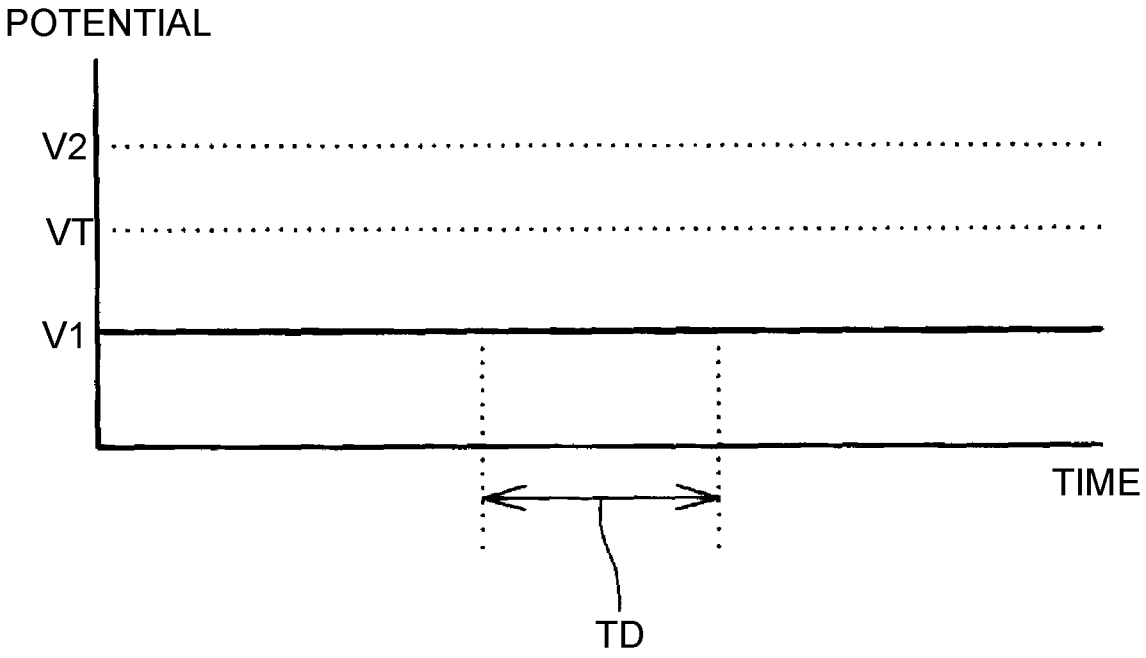
FIG. 3B is a graph showing no change in potential of the detection electrode in a case where ink has not been ejected from a nozzle.

In contrast, in a case where ink is not ejected from a nozzle 10 while the inkjet head 4 is driven, the potential of the detection electrode 91 hardly changes from the potential at which the inkjet head 4 is not driven in the driving period TD of the ink-jet head 4. Thus, as illustrated in FIG. 3B, the potential outputted from the output 94B hardly changes from the potential V1 in the driving period TD of the inkjet head 4.

The signal output circuit 94 thus outputs, from the output 94B, a signal responsive to whether a nozzle 10 is a failure nozzle that does not eject ink. As illustrated in FIG. 3A, a threshold value VT satisfying an equation V1<VT<V2 is specified to determine whether a nozzle 10 is a failure nozzle, such as a clogged nozzle, based on whether a maximum potential outputted from the output 94B exceeds a threshold value VT in the driving period TD of the inkjet head 4.

As described above, when the high-voltage power supply circuit 92 applies the voltage between the detection electrode 91 and the conductive portion of the inkjet head 4, and the inkjet head 4 is driven to eject ink from the nozzles 10 in the capped state, a leakage current greater than a predetermined value may flow between the detection electrode 91 and the inkjet head 4, for example, via ink adhering to the lip portion 71A of the cap 71. In the following, "a leakage current greater than a predetermined value flows" may refer to that "a leakage occurs".

When a leakage occurs, the potential of the detection electrode 91 changes. The change in the potential of the detection electrode 91 is much larger at the leakage than at which ink is ejected from the nozzle 10 to the detection electrode 91.

Thus, the signal output circuit 94 is structured such that the potential of the detection electrode 91 from which the high-voltage DC component has been removed at the filter circuit 95 is outputted from the output 94A without being amplified at the amplifier circuit 96. The signal output circuit 94 thus outputs, from the output 94A, a signal responsive to whether a leakage has occurred. The value of the signal varies responsively to the magnitude of the leakage current.

In this embodiment, the high-voltage power supply circuit 92 applies the voltage between the detection electrode 91 and the conductive portion of the inkjet head 4 by maintaining the conductive portion at the ground potential and applying the predetermined positive potential to the detection electrode 91. However, the high-voltage power supply circuit 92 may apply voltage between the detection electrode 91 and the conductive portion of the inkjet head 4 by maintaining the conductive portion at the ground potential and applying a predetermined negative potential (e.g., approximately −300 v) to the detection electrode 91. In this case, the rising and dropping of the potential outputted from the outputs 94A and 94B becomes opposite to that described above.

Alternatively, the high-voltage power supply circuit 92 may apply voltage between the detection electrode 91 and the conductive portion of the inkjet head 4 by applying a potential other than the ground potential to the conductive portion and applying a different potential to the detection electrode 91. In this case, when the high-voltage power supply circuit 92 applies, to the detection electrode 91, a potential higher than that of the conductive portion of the inkjet head 4, the rising and dropping of the potential outputted from the outputs 94A and 94B becomes similar to that described above. When the high-voltage power supply circuit 92 applies, to the detection electrode 91, a potential lower than that of the conductive portion of the inkjet head 4, the rising and dropping of the potential outputted from the outputs 94A and 94B becomes opposite to that described above.

The detection electrode 91 is connectable to a discharge circuit 97 via a switching element 98. The switching element 98 makes and breaks connection between the detection electrode 91 and the discharge circuit 97. The discharge circuit 97 is used to discharge electric charge from the inkjet head 4 when a leakage occurs.

Inkjet Head

Figure 4:
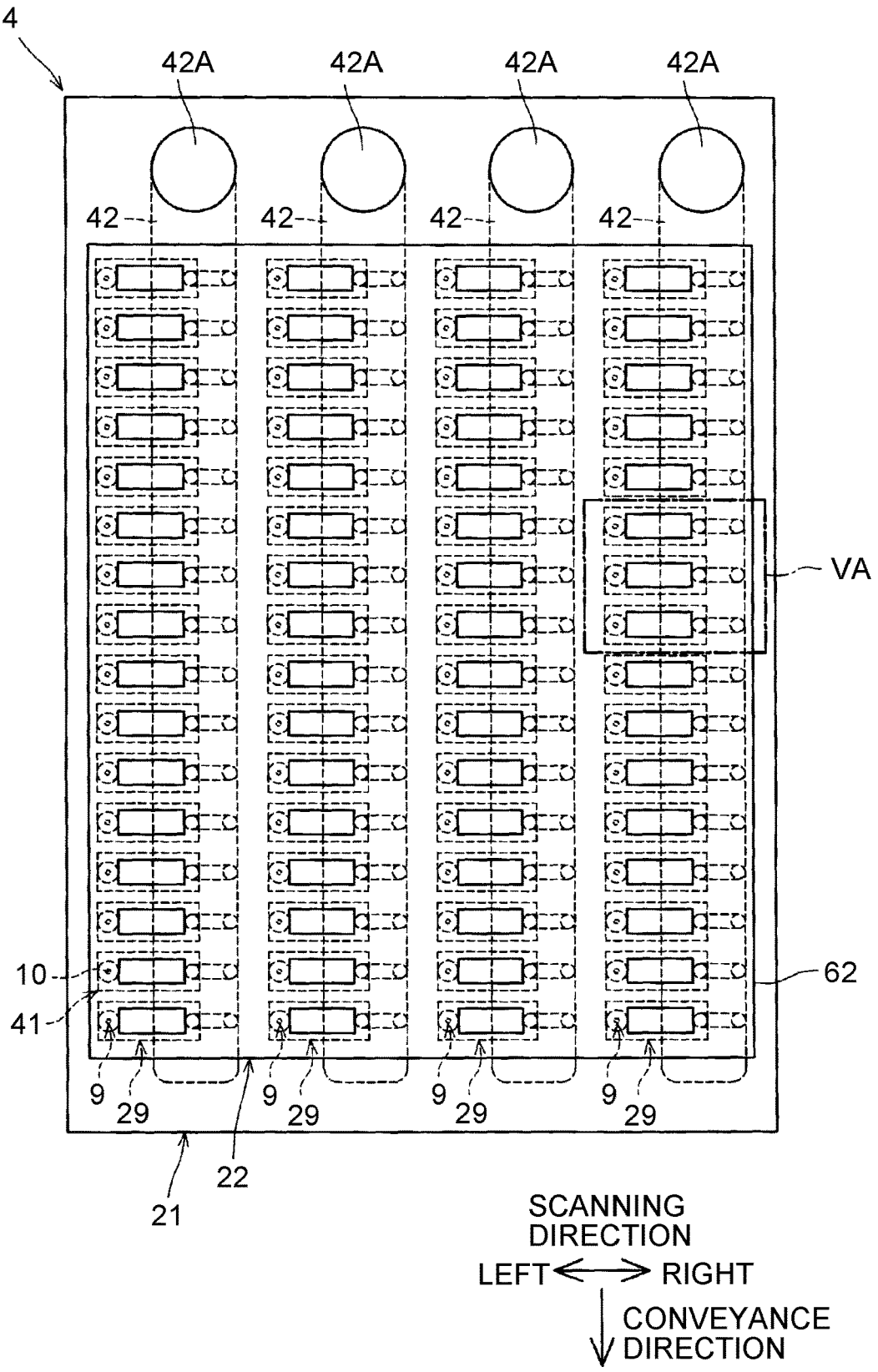
FIG. 4 is a plan view of an inkjet head of the printer in FIG. 1.
Figure 5A:
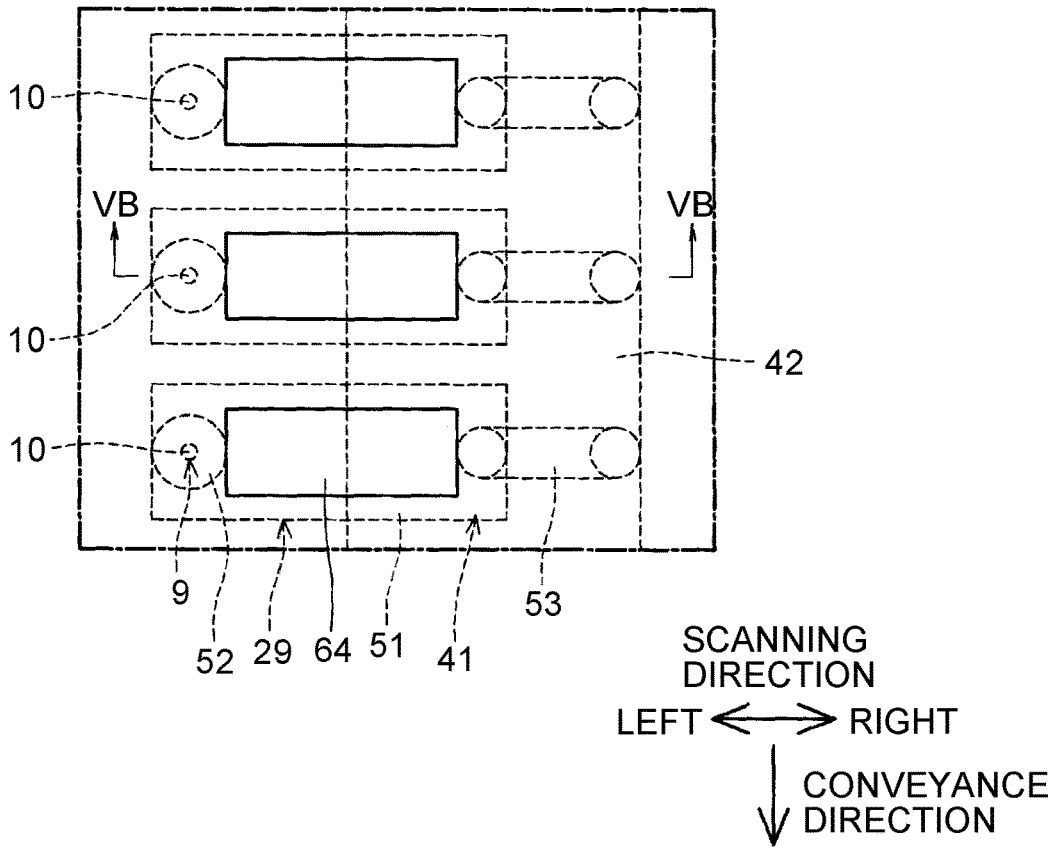
FIG. 5A is an enlarged view of a VA section of the inkjet head in FIG. 4.
Figure 5B:
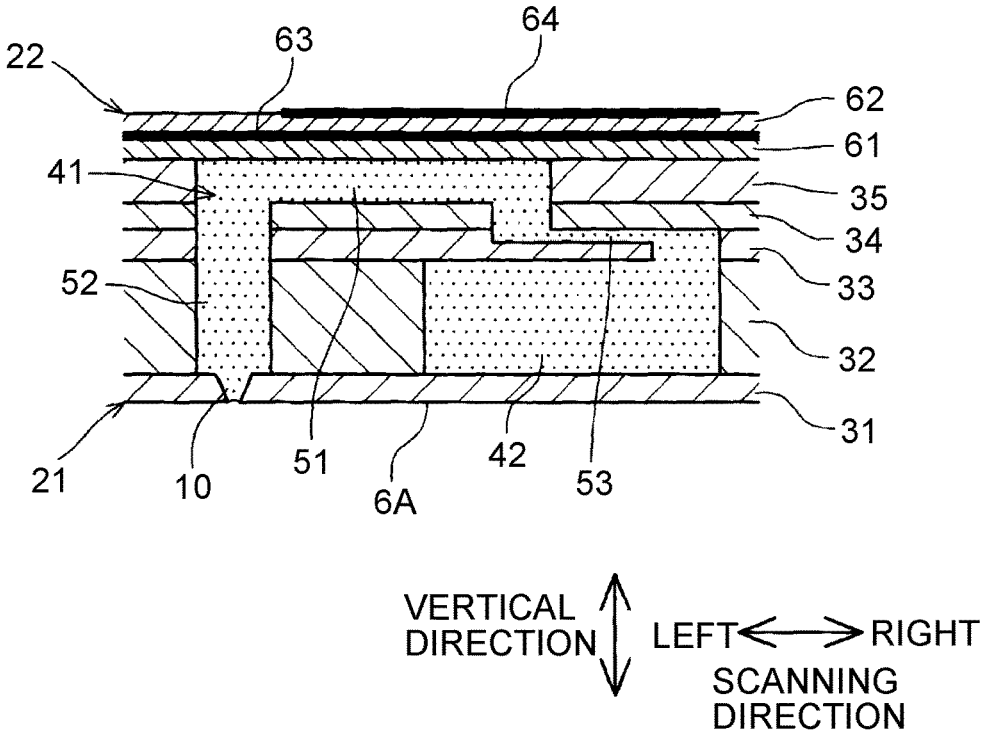
FIG. 5B is a cross-sectional view of the inkjet head taken along a VB-VB line of FIG. 5A.

A detailed configuration of the inkjet head 4 will be described. As illustrated in FIGS. 4, 5A, and 5B, the inkjet head 4 has a channel unit 21 and a piezoelectric actuator 22.

The channel unit 21 includes a plurality of, for example, five plates 31, 32, 33, 34, and 35 stacked on one above another in this order from below. The plate 31 is made of a synthetic resin material. The plates 32 to 35 are made of a conductive material such as metal. The stacked plates 31 to 35 are bonded, for example, by a thermosetting adhesive.

The channel unit 21 includes a plurality of individual channels 41 and four common channels 42. As with the nozzles 10 arranged in the four nozzle rows 9 as described above, the individual channels 41 are arranged in four individual-channel rows 29 each extending in the conveyance direction. The channel unit 21 has the four individual-channel rows 29 next to each other in the scanning direction.

Each individual channel 41 includes a nozzle 10, a pressure chamber 51, a descending channel 52, and a narrowed channel 53. The pressure chamber 51 has a left end in the scanning direction connected to the nozzle 10 via the descending channel 52, and a right end connected to the narrowed channel 53. The nozzle 10, the pressure chamber 51, the descending channel 52, and the narrowed channel 53 are similar in structure and positional relationship to those known in the art. Thus, further detailed description thereof will be omitted.

The four common channels 42 correspond to the four individual-channel rows 29. Each common channel 42 extends in the conveyance direction, and vertically overlaps right portions of individual channels 41 in a corresponding individual-channel row 29. Each common channel 42 is connected to right ends of the narrowed channels 53 included in the individual channels 41. Each common channel 42 has a supply port 42A at its upstream end in the conveyance direction. Ink is to be supplied from the supply port 42A.

The piezoelectric actuator 22 has a vibrating plate 61, a piezoelectric layer 62, a common electrode 63, and a plurality of individual electrodes 64. The vibrating plate 61 is made of a piezoelectric material having, as a main ingredient, lead zirconate titanate, which is a mixed crystal of lead titanate and lead zirconate. The vibrating plate 61 is disposed on an upper surface of the channel unit 21 (i.e., an upper surface of the plate 35) and covers the pressure chambers 51. The piezoelectric layer 62 is made of the piezoelectric material described above. The piezoelectric layer 62 is disposed on an upper surface of the vibrating plate 61 and extends continuously over the pressure chambers 51. In this embodiment, the vibrating plate 61 and the piezoelectric layer 62 are made of a piezoelectric material. In some embodiments, the vibrating plate 61 may be made of an insulating material other than a piezoelectric material, for example, a synthetic resin material.

The common electrode 63 is disposed between the vibrating plate 61 and the piezoelectric layer 62, and extends over their entire surfaces. The common electrode 63 is connected to a power supply via a wire and maintained at the ground potential. The individual electrodes 64 are disposed on an upper surface of the piezoelectric layer 62. Each individual electrode 64 is provided for a corresponding pressure chamber 51 and vertically overlaps a central portion of the corresponding pressure chamber 51. Each individual electrode 64 is connected to a driver IC 89 (in FIG. 6) via a corresponding wire. Each individual electrode 64 receives the ground potential or a predetermined drive potential (e.g., approximately 20 v) selectively from the driver IC 89. As the common electrode 63 and the individual electrodes 64 are disposed as described above, the piezoelectric layer 62 is polarized at portions sandwiched between the common electrode 63 and the individual electrodes 64 in its thickness direction.

The piezoelectric actuator 22 changes a potential difference between the common electrode 63 and each individual electrode 64 carrying a potential supplied from the driver IC 89 to deform the piezoelectric layer 62 and portions of the vibrating plate 61 vertically overlapping with the pressure chambers 51. This fluctuates ink pressure in the pressure chambers 51, thus enabling the nozzles 10 communicating with the pressure chambers 51 to eject ink.

Electrical Configuration of Printer

Figure 6:
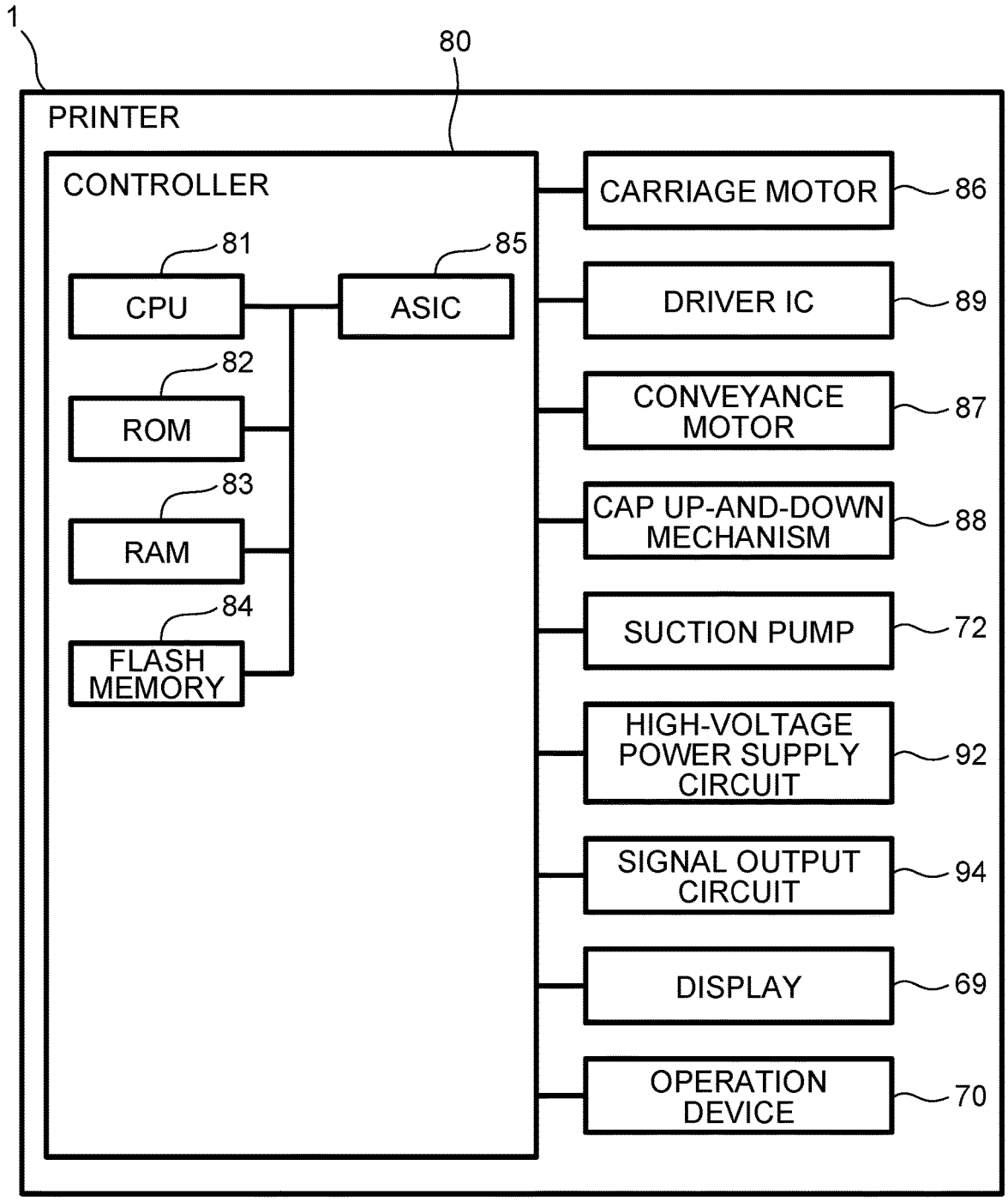
FIG. 6 is a block diagram illustrating an electrical configuration of the printer.

Hereinafter, a description will be provided on an electrical configuration of the printer 1. As illustrated in FIG. 6, the printer 1 includes a controller 80 that controls operation of the printer 1. The controller 80 includes a CPU 81, a ROM 82, a RAM 83, a flash memory 84, and an ASIC 85. The controller 80 controls the carriage motor 86, the driver IC 89, the conveyance motor 87, the cap up-and-down mechanism 88, the suction pump 72, and the high-voltage power supply circuit 92. The carriage motor 86 is connected to the carriage 2 via a belt. In response to driving of the carriage motor 86, the carriage 2 is configured to move in the scanning direction along the guide rails 11 and 12. The conveyance motor 87 is connected to the conveyance rollers 6 and 7 via gears. In response to driving of the conveyance motor 87, the conveyance rollers 6 and 7 are configured to rotate to convey a recording sheet P in the conveyance direction. The cap up-and-down mechanism 88 is configured to control the cap 71 to move upward and downward selectively. In this embodiment, the controller 80 controls the inkjet head 4 by controlling the driver IC 89.

The controller 80 receives a signal responsive to whether a nozzle is a failure nozzle, from the output 94B of the signal output circuit 94. The controller 80 receives a signal responsive to whether a leakage has occurred, from the output 94A of the signal output circuit 94.

The printer 1 includes a display 69 (as an example of a notification device) and an operation device 70. The display 69 may include a liquid crystal display. The controller 80 controls the display 69 to display information and messages related to the operations of the printer 1. The operation device 70 includes buttons provided on the printer 1 and a touch screen provided on the display 69. In response to the user operating the operation device 70, the controller 80 receives a signal responsive to the operation.

In the controller 80, only the CPU 81 or the ASIC 85 may perform all processing or a combination of the CPU 81 and the ASIC 85 may perform all processing. Alternatively, the controller 80 may include a single CPU 81 that may perform all processing or include a plurality of CPUs 81 that may share all processing. Alternatively, the controller 80 may include a single ASIC 85 that may perform all processing or include a plurality of ASICs 85 that may share all processing.

Control During Image Recording

Hereinafter, a description will be provided on a process of recording an image on a recording sheet P in the printer 1. In the printer 1, in response to receiving a recording instruction to instruct image recording, the controller 80 executes processing in accordance with the flowchart of FIG. 7.

More specifically, in response to receiving the recording instruction, the controller 80 starts ejection determination to determine, as to each nozzle 10, whether a nozzle 10 is a failure nozzle that does not eject ink (S101).

Figure 8:
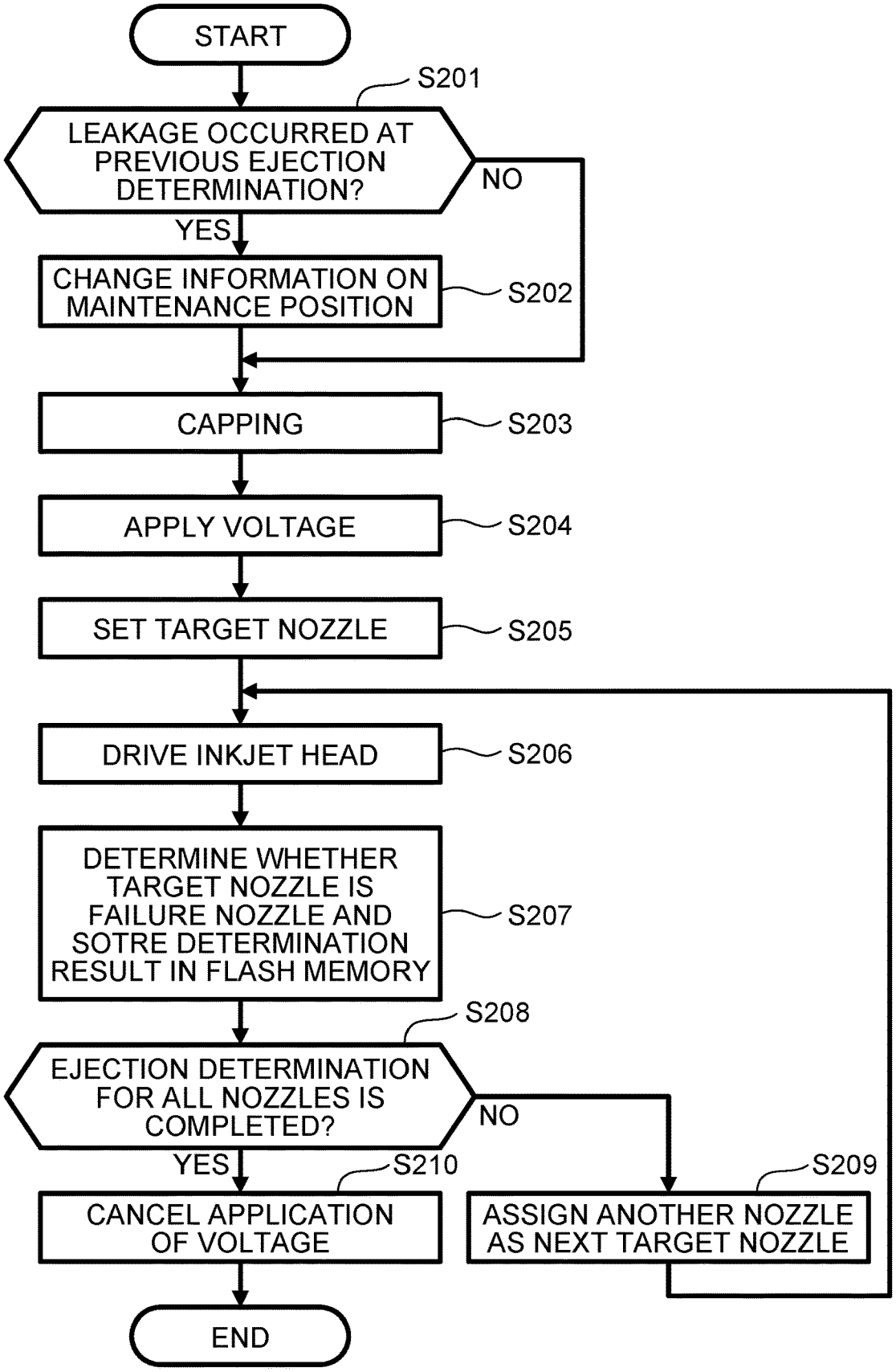
FIG. 8 is a flowchart of an ejection determination process.

The step of the ejection determination in S101 is a process performed by the controller 80 in accordance with the flowchart of FIG. 8. In the flowchart of FIG. 8, the controller 80 determines whether a leakage occurred in the previous ejection determination (S201).

If the controller 80 determines that any leakage did not occur at the previous ejection determination (S201: NO), the process proceeds to S203. If the controller 80 determines that a leakage occurred in the previous ejection determination (S201: YES), the controller 80 changes information on a maintenance position (S202) and proceeds to S203.

The information on the maintenance position is stored in the flash memory 84. In S202, the controller 80 changes the information on the maintenance position in such a manner to increase a distance in the scanning direction between a nozzle 10, determined as a leakage nozzle in S110 described later, and an end, closer to the nozzle 10, of the lip portion 71A of the cap 71 further than that in the previous ejection determination.

In step S203, the controller 80 performs capping. In capping in S203, the controller 80 controls, based on the information on the maintenance position stored in the flash memory 84, the carriage motor 86 to move the carriage 2 to the maintenance position, and controls the cap up-and-down mechanism 88 to raise the cap 71 to set the cap 71 in the capping state.

In a case where no leakage occurred in the previous ejection determination, positions of the inkjet head 4 and the cap 71 in the capping state in the current ejection determination are the same as in the previous ejection determination. In contrast, in a case where a leakage occurred in the previous ejection determination, the positions of the inkjet head 4 and the cap 71 in the capping state in the current ejection determination are different in the scanning direction from those in the previous ejection determination.

Subsequently, the controller 80 controls the high-voltage power supply circuit 92 to apply voltage between the detection electrode 91 and the inkjet head 4 (S204). The controller 80 sets one of the nozzles 10 of the inkjet head 4 as a target nozzle to be determined as to whether it is a failure nozzle (S205).

The controller 80 then drives the inkjet head 4 to eject ink from the target nozzle 10 set in S205 (S206). The controller 80 determines whether the target nozzle is a failure nozzle based on the signal outputted from the output 94B, and store a determination result in the flash memory 84 (S207).

The controller 80 determines whether the ejection determination for all the nozzles 10 of the inkjet head 4 has been completed (S208). If the controller 80 determines that the ejection determination for all the nozzles 10 of the inkjet head 4 has not been completed (S208: NO), the controller 80 assigns another nozzle 10 as the next target nozzle among one or more nozzles 10 that have not been subjected to the ejection determination (S209) and returns to step S206. In response to a condition that the ejection determination for all the nozzles 10 of the inkjet head 4 is completed, the controller 80 controls the high-voltage power supply circuit 92 to cancel the application of voltage between the detection electrode 91 and the inkjet head 4 (S210) and ends the process.

Figure 7:
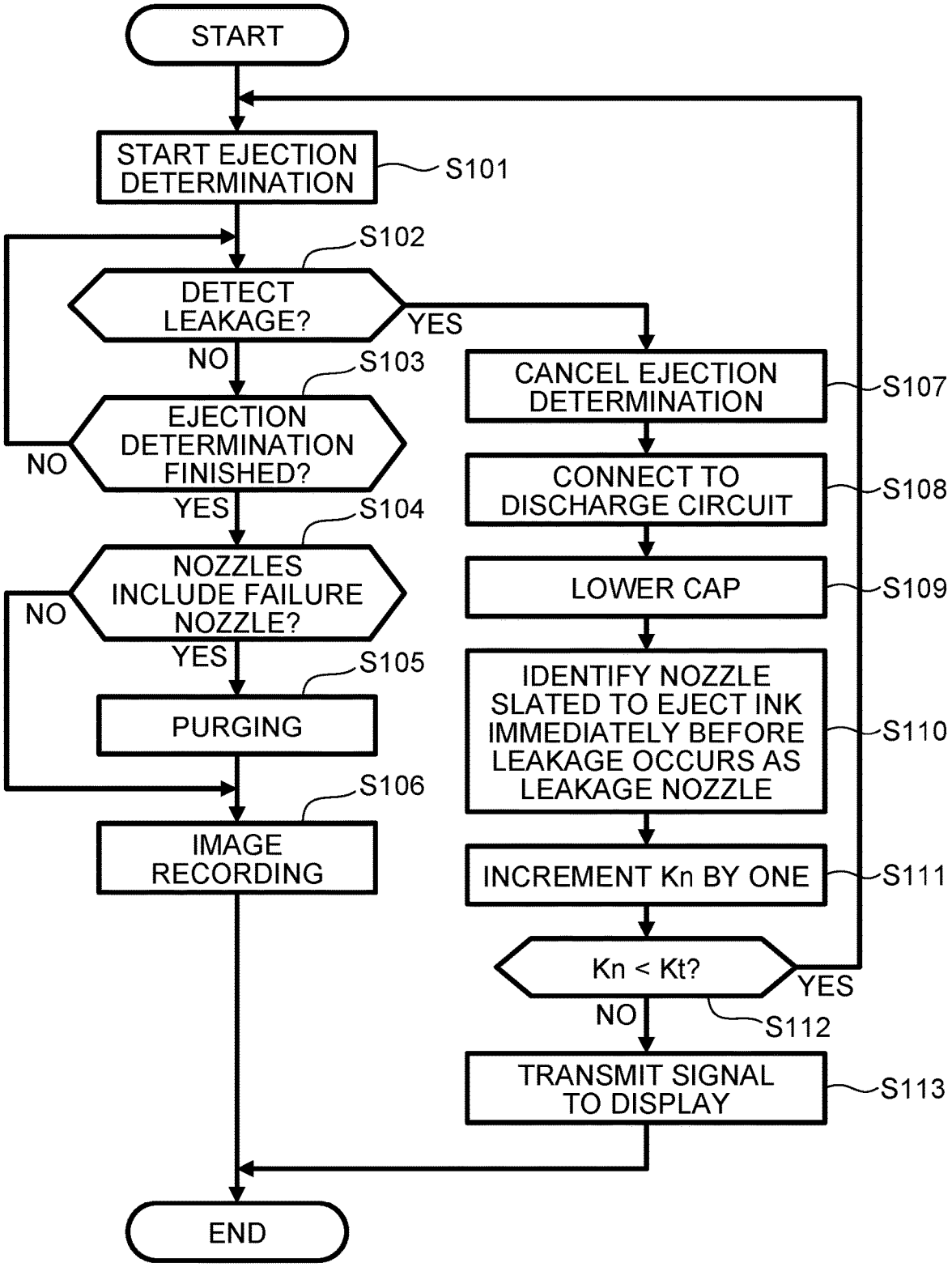
FIG. 7 is a flowchart of a process to be performed during image recording.

After starting the ejection determination in S101 in FIG. 7, while the controller 80 does not detect a leakage based on a signal from the output 94A (S102: NO) and the ejection determination is not finished (S103: NO), the controller 80 continues the ejection detection. If the controller 80 does not detect a leakage (S102: NO) and the ejection determination has been finished (S103: YES), the controller 80 determines whether the nozzles 10 of the inkjet head 4 include a failure nozzle based on a result of the ejection determination as to each nozzle (S104).

If the controller 80 determines that the nozzles 10 do not include a failure nozzle (S104: NO), the process proceeds to S106. If the controller 80 determines that the nozzles 10 include a failure nozzle (S104: YES), the controller 80 executes purging (S105) and then proceeds image recording in S106. In purging in S105, the controller 80 controls the suction pump 72 to perform the suction purge described above.

In image recording in S106, the controller 80 controls the carriage motor 86 to move the carriage 2 in the scanning direction, and controls the driver IC 89 to cause the inkjet head 4 to eject ink from the nozzles 10, and controls the conveyance motor 87 to cause the conveyance rollers 6 and 7 to convey a recording sheet P for a predetermined distance. The controller 80 controls them repeatedly to record an image on the recording sheet P.

In contrast, if the controller 80 determines that a leakage has occurred based on a signal from the output 94*a* (S102: YES), the controller 80 cancels the ejection determination (S107). At this time, the controller 80 controls the high-voltage power supply circuit 92 to cancel the application of voltage between the detection electrode 91 and the inkjet head 4.

Subsequently, the controller 80 controls the switching element 98 to connect the detection electrode 91 to the discharge circuit 97 (S108). The inkjet head 4 has capacitance. When a leakage current flows, the inkjet head 4 is charged with electric charge. When the detection electrode 91 is connected to the discharge circuit 97, electric charge in the inkjet head 4 is discharged via the detection electrode 91 and the discharge circuit 97.

Subsequently, the controller 80 controls the cap up-and-down mechanism 88 to lower the cap 71 such that the cap 71 is spaced from the inkjet head 4 (S109). At this time, the cap 71 is in an uncapping state and the nozzles 10 of the inkjet head 4 are in an uncapped state. This interrupts the current between the detection electrode 91 and the inkjet head 4 via the cap 71, to eliminate a cause of a leakage.

Subsequently, the controller 80 identifies a nozzle 10 slated to eject ink immediately before a leak occurs as a leakage nozzle (S110). More specifically, a nozzle 10 is set as a target nozzle and the inkjet head 4 is driven to eject ink from the target nozzle in S206. In a case where a leakage is determined to have occurred after S206, the target nozzle 10 is identified as a leakage nozzle. If a leakage is determined to have occurred before the inkjet head 4 is driven to eject ink from the target nozzle in S206, a nozzle 10 set as a target nozzle just before the current target nozzle is identified as a leakage nozzle.

Subsequently, the controller 80 increments a variable KN provided for a nozzle 10 identified as a leakage nozzle by one (S111). In this embodiment, the nozzles 10 of the inkjet head 4 are numbered. The variable KN corresponds to the number of times of a leakage where a leakage has occurred in a nozzle 10 having a number N. In this embodiment, incrementing the variable KN by one in S111 corresponds to "counting the number of times of a leakage".

The controller 80 then determines whether the variable KN of which value has been incremented in S111 is below a threshold value KT (S112). The threshold value KT is a value of the variable KN when the number of times of a leakage reaches a predetermined number of times. If the variable KN is below the threshold value KT (i.e., the number of times of a leakage is below the predetermined number of times) (S112: YES), the process returns to S101. In the ejection determination in S101 returning from S112, a determination whether a nozzle 10 is a failure nozzle may be made for all nozzles 10 of the inkjet head 4 newly or only for one or more nozzles 10 that have not been subjected to the ejection determination.

In contrast, if the variable KN reaches the threshold value KT (i.e., the number of times of a leakage reaches the predetermined number of times) (S112: NO), the controller 80 transmits, to the display 69, a notification signal indicating that the number of times of a leakage in the same nozzle 10 has reached the predetermined number of times (S113), and the process ends. In response to receiving the notification signal transmitted in S113, the display 69 displays a message notifying that the number of times of a leakage in the same nozzle 10 has reached the predetermined number of times.

Effects

In response to the occurrence of a leakage, ink is electrolyzed. This may cause hydrogen gas in the individual channels 41, thereby increasing ink pressure. The electrolysis may change ink properties. When a leakage occurs, a leakage current greater than the predetermined value flows between a nozzle 10 and the detection electrode 91. From these facts, when a leakage occurs, for example, a portion of the plate 31 in the vicinity of the nozzle 10 in which the leakage occurs may be separated from the plate 32, and the nozzle 10 may be damaged by a deposit of ink to be produced through electrolysis. Therefore, if the leakage current greater than the predetermined value flows in the same nozzle 10 repeatedly, the plate 31 may be separated from the plate 32 more spatially, and the nozzle 10 may be damaged more badly and finally cannot eject ink.

In contrast, in this embodiment, in response to the occurrence of a leakage, the controller 80 can identify a nozzle 10 where the leakage occurs based on a result of the ejection determination. This monitors each nozzle 10 of the inkjet head 4, thus estimating the degree of damage to a nozzle 10 by a leakage.

Further, in this embodiment, the ejection determination is performed for each of the nozzles 10 in the capped state. This enables the shortest distance between the inkjet head 4 and the detection electrode 91, thus increasing the change in the electric potential of the detection electrode 91 when ink is ejected from the nozzle 10. For the ejection determination with the cap 71 in the capping state, a leakage is likely to occur between the detection electrode 91 and a nozzle 10 via ink adhering to the lip portion 71A of the cap 71. Therefore, when a leakage occurs, a result of the ejection determination is beneficially used to identify a leakage nozzle 10.

In the above embodiment, when a leakage occurs, a leakage current can be interrupted by setting the cap 71 in the uncapping state or separating the cap 71 from the inkjet head 4.

After the cap 71 is set back to the capping state, an ejection determination is performed. If the positions of the inkjet head 4 and the cap 71 in the capping state in the current ejection determination is the same as in the previous ejection determination, a leakage is likely to reoccur between the same nozzle 10 (or a leakage nozzle) and the cap 71. In this embodiment, however, in an ejection determination where the cap 71 is set back to the capping state after being set to the uncapping state on the occurrence of a leakage, the inkjet head 4 is shifted in the scanning direction relative to the cap 71 such that the leakage nozzle and the lip portion 71A are spaced in the scanning direction further than in the previous ejection determination. This reduces the likeliness that a leakage reoccurs between the same nozzle 10 and the cap 71.

As described above, if a leakage occurs in the same nozzles 10 repeatedly, the nozzle 10 may become unable to eject ink. In this embodiment, when the number of times of a leakage in a nozzle 10 has reached the predetermined number of times and the variable KN provided for the nozzle 10 has reached the threshold value KT, the controller 80 transmits a notification signal indicating such information (i.e., existence of a nozzle at which a leakage has occurred the predetermined number of times) to the display 69. The display 69 in turn shows a message to notify a user that an error is encountered.

A leakage during an ejection determination may be caused by contact of ink in a nozzle 10, which is slated to eject ink just before the leakage occurrence, with ink adhering to the lip portion 71A. In this embodiment, the nozzle 10 slated to eject ink just before the leakage occurrence is identified as a leakage nozzle.

In this embodiment, as described above, the change in the potential of the detection electrode 91 is much smaller when ink is ejected from a nozzle 10 during an ejection determination than when a leakage occurs. In this embodiment, the signal output circuit 94 includes the outputs 94A and 94B. The output 94A outputs a potential of the detection electrode 91 from which a high-voltage DC component applied by the high-voltage power supply circuit 92 has been removed. The output 94B outputs the potential of the detection electrode 91 amplified at the amplifier circuit 96. The controller 80 uses a signal outputted from the output 94A to determine whether a leakage has occurred and a signal outputted from the output 94B to determine whether ink is ejected from the nozzle 10.

In this embodiment, when a leakage occurs, the detection electrode 91 is connected to the discharge circuit 97 to discharge the electric charge accumulated in the inkjet head 4 due to a leakage current flow via the discharge circuit 97. When a leakage occurs, electric charge is charged in the capacitance of the inkjet head 4 and electrolysis of ink proceeds mainly after the completion of charging. If a leakage reoccurs with the electric charge staying charged in the capacitance of the inkjet head 4, the electrolysis of ink immediately proceeds. In this embodiment, the discharge circuit 97 discharges the electric charge accumulated in the inkjet head 4. This reduces the electrolysis of ink from immediately proceeding on the occurrence of a next leakage.

Modifications

While the disclosure has been described in detail with reference to the specific embodiment thereof, this is merely an example, and various changes, arrangements and modifications may be applied therein without departing from the spirit and scope of the disclosure.

In the above embodiment, a nozzle 10 set as a target for an ejection determination when a leakage occurs is identified as a leakage nozzle.

Figure 9:
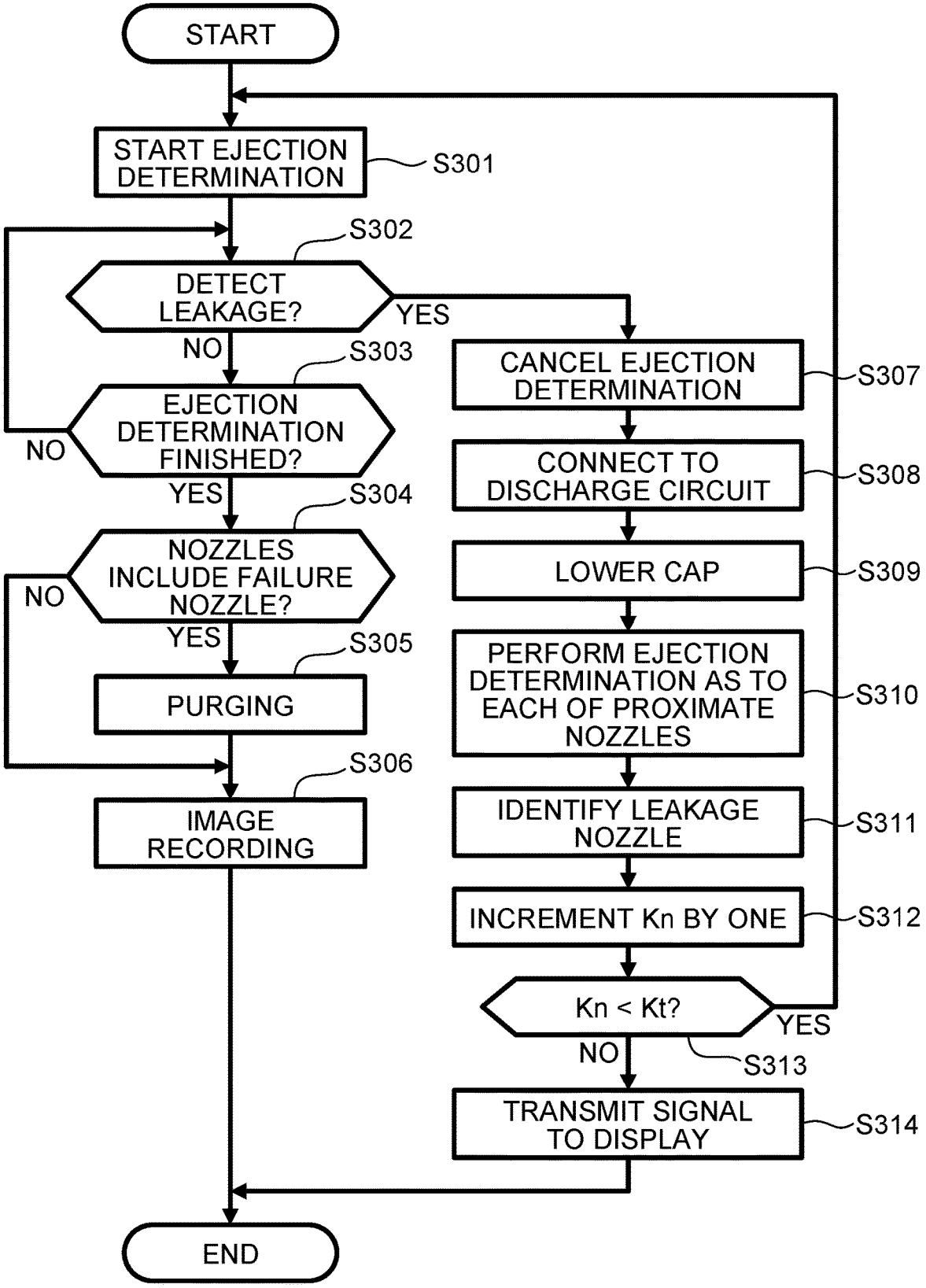
FIG. 9 is a flowchart according to a first modification, corresponding to FIG. 7.

In a first modification, in response to receiving a recording instruction, the controller 80 executes processing in accordance with the flowchart of FIG. 9. In FIG. 9, steps S301 to S309 and S312 to S314 are the same as steps S101 to S109 and S111 to S113 in the above embodiment, and the detailed description thereof can be omitted for the sake of brevity. In the first modification, the controller 80 lowers the cap 71 such that the nozzles 10 of the inkjet head 4 are in the uncapped state (S309). The controller 80 then performs an ejection determination as to each of proximate nozzles 10 that are proximate to the lip portion 71A in the inkjet (S310).

The positional relationship between the nozzles 10 of the inkjet head 4 and the lip portion 71A of the cap 71 in the scanning direction varies according to a maintenance position. In S310, the proximate nozzles 10 refer to, for example, in FIG. 2, nozzles 10 in the rightmost nozzle row 9 when a distance DR between the rightmost nozzle row 9 and a right portion of the lip portion 71A in the scanning direction is shorter than a distance DL between the leftmost nozzle row 9 and a left portion of the lip portion 71A. When the distance DR is longer than the distance DL, the proximate nozzles 10 refer to nozzles 10 in the leftmost nozzle row 9. When the distance DR is equal to the distance DL, the proximate nozzles 10 refer to nozzles 10 in the rightmost nozzle row 9 and nozzles 10 in the leftmost nozzle row 9.

In S310, the controller 80 determines whether each of the proximate nozzles is a failure nozzle in a similar sequence to steps S202 to S210 in FIG. 8.

When a leakage occurs, a leakage current often flows through ink adhering to the lip portion 71A protruding toward the inkjet head 4. In other words, when a leakage occurs, the leakage is likely to occur in any of the proximate nozzles 10 proximate to the lip portion 71A in the inkjet head 4. In addition, a nozzle 10 where a leakage has occurred is less likely to eject ink normally due to, for example, deposits of ink electrolyzed by a leakage current. In the first modification, when a leakage occurs during the ejection determination, the controller 80 performs the ejection determination as to each of the proximate nozzles to determine whether a nozzle is a failure nozzle, and identifies the nozzle determined as a failure nozzle, as a leakage nozzle.

A result of the ejection determination used to identify a leakage nozzle may be different from that used in the above embodiment or the first modification. For example, the ejection determination may be continuously performed and the number of failure nozzles may be counted until a leakage occurs. A nozzle 10 counted as the last one of the failure nozzles may be identified as a leakage nozzle.

In the above embodiment, in an ejection determination to be performed under that a leakage occurred in a nozzle 10 in the previous ejection determination, the maintenance position is shifted in the scanning direction such that the nozzle 10 and the lip portion 71A are spaced from each other in the scanning direction. In some embodiments, the cap 71 may be movable in the scanning direction while the maintenance position is unchanged. Alternatively, the maintenance position and the position of the cap 71 may be shiftable in the scanning direction.

The inkjet head 4 (or the carriage 2) and the cap 71 may be moved in a direction other than the scanning direction. Either the inkjet head 4 or the cap 71 may be movable in the conveyance direction to change the positions of the inkjet head 4 and the cap 71 in the capping state in the conveyance direction.

In the current ejection determination, the positions of the inkjet head 4 and the cap 71 in the capping state may not be changed in the scanning direction from those in the previous ejection determination even in which a leakage occurred.

In the above embodiment, the signal output circuit 94 includes the outputs 94A and 94B. The output 94A outputs, to the controller 80, a potential of the detection electrode 91 from which a high-voltage DC component has been removed by the filter circuit 95. The output 94B outputs the potential of the detection electrode 91 amplified at the amplifier circuit 96 to the controller 80.

Figure 10:
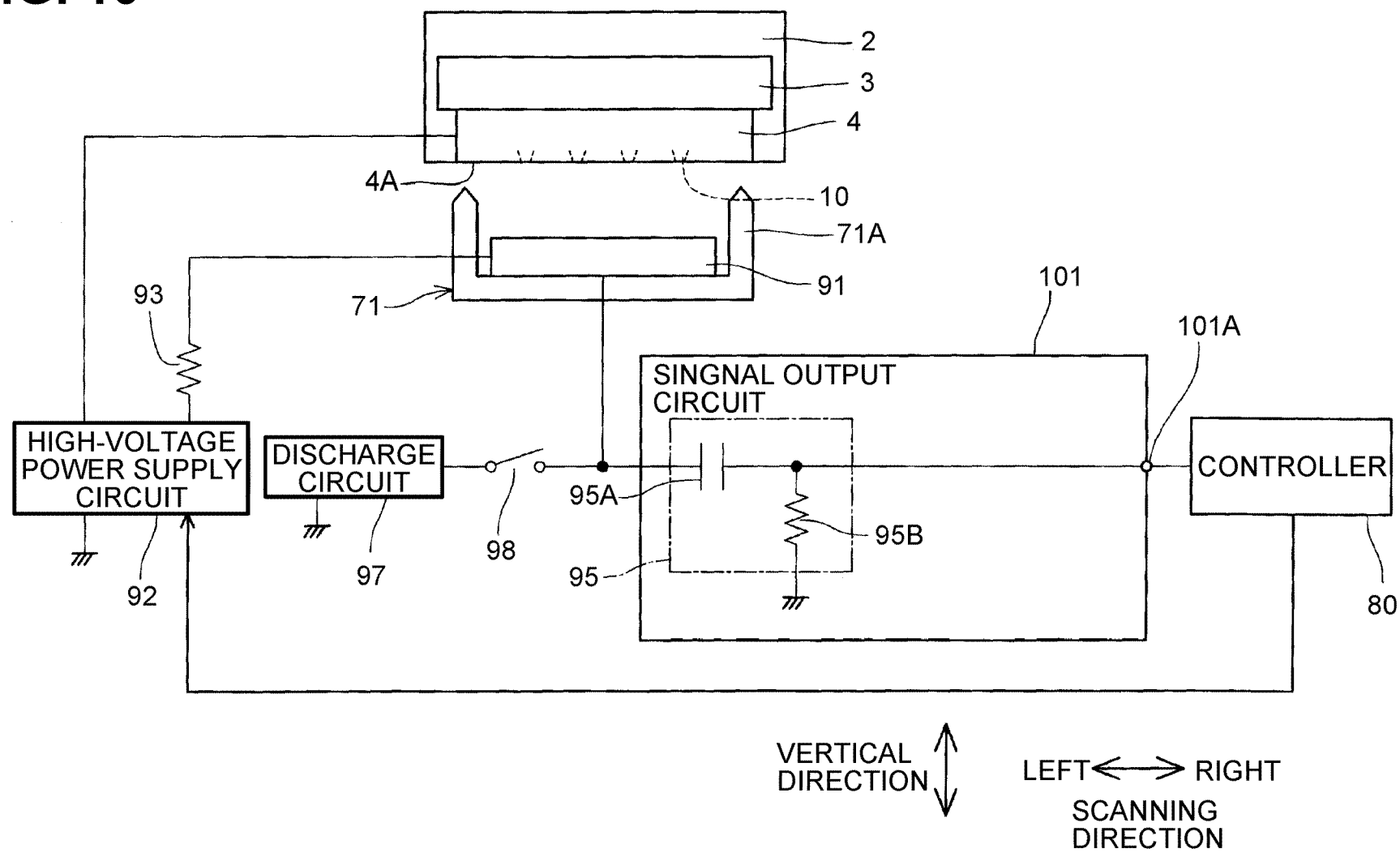
FIG. 10 is a schematic diagram according to a second modification, corresponding to FIG. 2.

As illustrated in FIG. 10, a second modification provides a signal output circuit 101 having only an output 101A that outputs, to the controller 80, a potential of the detection electrode 91 from which a high-voltage DC component has been removed by the filter circuit 95.

In the second modification, in response to receiving a recording instruction, the controller 80 executes processing in accordance with the flowcharts of FIGS. 7 and 8 as in the above embodiment. In the second modification, the output 101A is configured to output both of a signal corresponding to a change in the potential of the detection electrode 91 when ink is ejected from a nozzle 10 in an ejection determination and a signal corresponding to a change in the potential of the detection electrode 91 when a leakage occurs. Both signals may differ in potential waveform.

In the second modification, to perform steps in S102 and S207, the controller 80 uses a potential waveform outputted from the output 101A to determine whether a signal outputted from the output 101A is a signal corresponding to a change in the potential of the detection electrode 91 when ink is ejected from a nozzle 10 in the ejection determination or a signal corresponding to a change in the potential of the detection electrode 91 when a leakage occurs.

In the second modification, the two types of signals outputted from the output 101A in the ejection determination are distinguishable from each other based on a waveform of a signal outputted from the output 101A as described above.

In the second modification, the output 101A outputs, to the controller 80, a potential of the detection electrode 91 from which a high-voltage DC component has been removed by the filter circuit 95. However, the output 101A may output a potential of the detection electrode 91 amplified at the amplifier circuit to the controller 80.

In the above embodiment, when the number of times of a leakage in a nozzle 10 has reached the predetermined number of times and the variable KN for the nozzle 10 has reached the threshold value KT, the controller 80 transmits a notification signal indicating such information to the display 69. However, the controller 80 may transmit a notification signal to a device other than the display 69.

Figure 11:
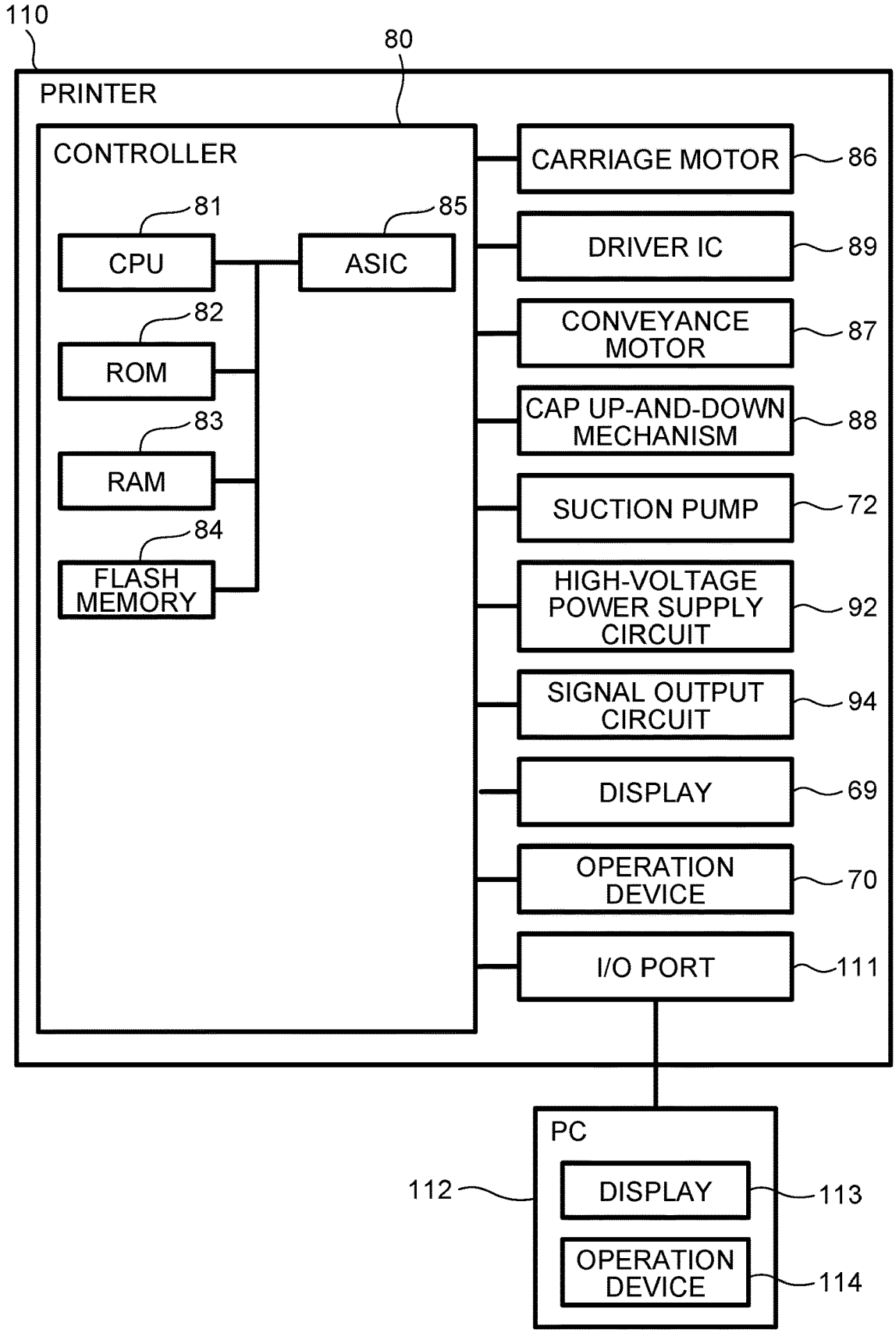
FIG. 11 is a block diagram according to a third modification, corresponding to FIG. 6.

As illustrated in FIG. 11, a third modification provides a printer 110 including an input output (I/O) port 111 in addition to elements similar to the printer 1. The I/O port 111 is, for example, a USB (Universal Serial Bus) port. The controller 80 is connected via the I/O port 111 to a PC 112 (as an example of an external device) external to the printer 110. In the third modification, a recording instruction is transmitted from the PC 112 to the controller 80 via the I/O port 111. The PC 112 includes a display 113 (as an example of a notification device) and an operation device 114. The display 113 may include a liquid crystal display and display information and messages related to the operations of the printer 110 at the PC 112. The operation device 114 includes input devices such as a mouse and a keyboard.

Figure 12:
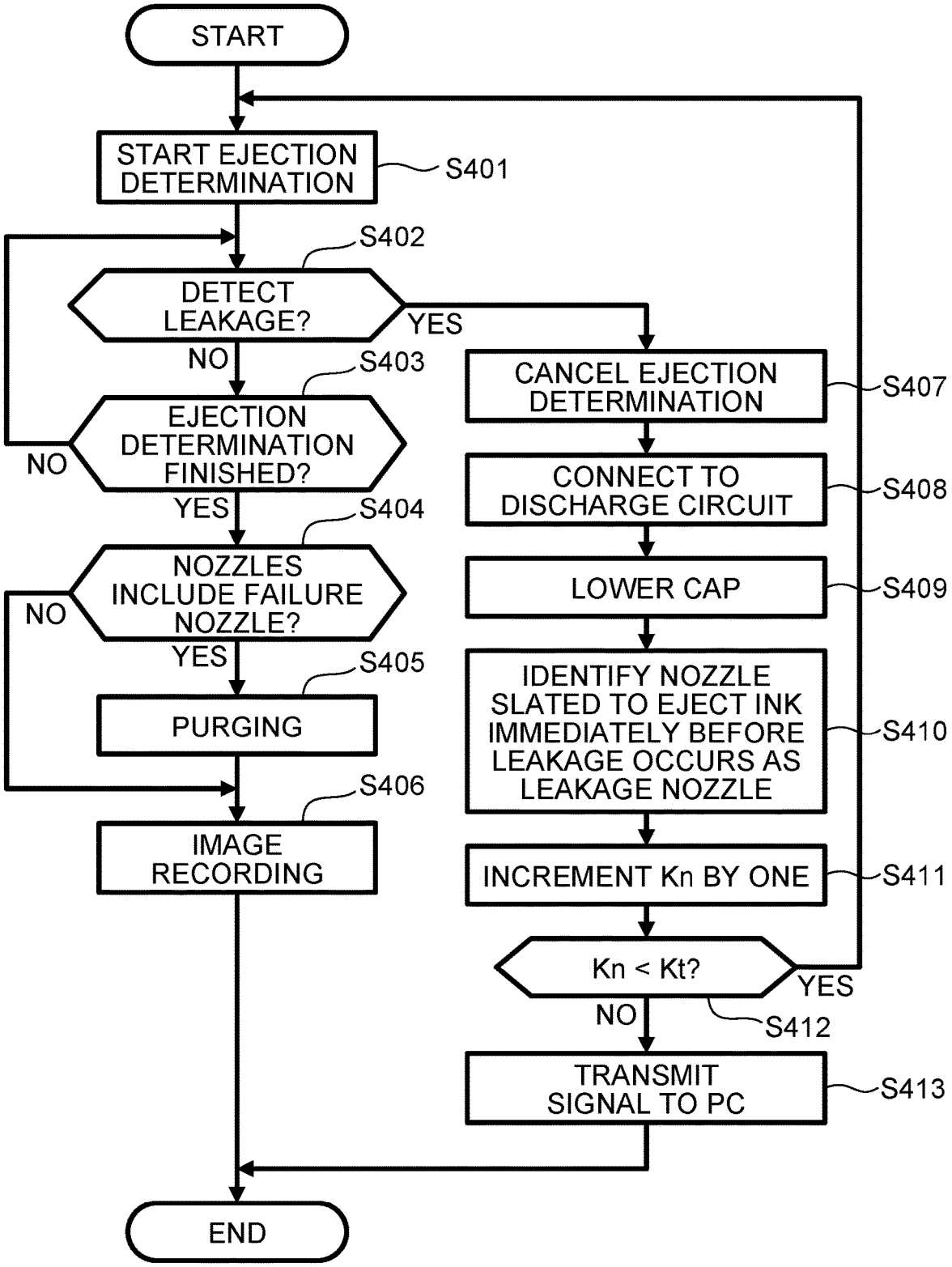
FIG. 12 is a flowchart according to the third modification, corresponding to FIG. 7.

In the printer 110, in response to receiving a recording instruction, the controller 80 executes processing in accordance with the flowchart of FIG. 12. In FIG. 12, steps S401 to S412 are the same as steps S101 to S112 in the above embodiment, and the detailed description thereof can be omitted for the sake of brevity. In the third modification, when the variable KN reaches the threshold value KT (S412: NO), the controller 80 transmits a notification signal to the PC 112 (S413). In the PC 112, in response to receiving the notification signal transmitted in S413, the display 113 displays a message indicating that an error is encountered.

As described above, if a leakage occurs in the same nozzles 10 repeatedly, the nozzle 10 may become unable to eject ink. In the third modification, when the number of times of a leakage in a nozzle 10 has reached the predetermined number of times and the variable KN provided for the nozzle 10 has reached the threshold value KT, the controller 80 transmits a notification signal indicating such information to the PC 112. The display 113 of the PC 112 in turn shows a message to notify a user that an error is encountered.

In the above embodiment, when a leakage nozzle is identified, the variable KN provided for the leakage nozzle is incremented, and when the variable KN reaches the threshold value KT, a notification signal is transmitted. However, a notification signal may be transmitted at a timing other than the above. For example, assume that an initial value of the variable KN is a value corresponding to the predetermined number of times. When a leakage nozzle is identified, the value of the variable KN provided for the leakage nozzle may be reduced. When the variable KN is reduced to zero, a notification signal may be transmitted.

In the above embodiment, the display 69 of the printer 1 is an example of a notification device that provides notification in response to receiving a notification signal from the controller 80. In the third modification, the display 113 of the PC 112 is an example of such a notification device. However, the notification device is not limited to such displays. For example, a speaker included in the printer or the PC may function as a notification device. The controller 80 may transmit a notification signal to cause the notification device to provide notification.

In the above embodiment, when a leakage occurs, the detection electrode 91 is connected to the discharge circuit 97 to discharge the electric charge accumulated in the inkjet head 4 due to a leakage current flow via the discharge circuit 97. However, the electric charge may be discharged in a different manner. The discharge circuit 97 may be eliminated from the printer 1. When the ejection determination is canceled in response to the occurrence of a leakage, the cap 71 may be immediately lowered to be in the uncapping state. Even in this case, which may require more time than a case where connected to the discharge circuit 97, the electric charge may be naturally discharged from the inkjet head 4 over time with the cap 71 in the uncapping state.

In the above embodiment, when a leakage occurs, the cap 71 is lowered to be in the uncapping state. However, the cap 71 may not be in the uncapping state. For example, when a leakage occurs, an ejection determination may be canceled, voltage application by the high-voltage power supply circuit 92 may be canceled, and then the cap 71 may remain in the capping state. Even in this case, as the voltage application by the high-voltage power supply circuit 92 is canceled, no further leakage current flows.

In the above embodiment, when an ejection determination is performed, the nozzles 10 are set in the capped state, and the inkjet head 4 is driven to eject ink from a target nozzle. However, the nozzles 10 may not be set in the capped state. In an ejection determination, the cap 71 may be at a position midway between a position when in the capping state and a position when in the uncapping state such that the cap 71 is slightly spaced from the inkjet head 4. With this state, the inkjet head 4 may be driven to eject ink from the target nozzle.

The above examples show, but not limited to, that the cap 71 and the inkjet head 4 are vertically moved relative to each other by raising and lowering the cap 71. For example, the carriage 2 may be vertically movable such that the cap 71 and the inkjet head 4 are vertically moved relative to each other. In this case, a combination of the carriage 2 and a mechanism for moving the carriage 2 is an example of a relative movement device. Alternatively, the cap 71 and the inkjet head 4 may be vertically moved relative to each other by raising and lowering both of the cap 71 and the carriage 2. In this case, the carriage 2, a combination of the cap up-and-down mechanism 88, and a mechanism for moving the carriage 2 is an example of a relative movement device.

The above embodiment shows, but is not limited to, purging where ink in the inkjet head 4 is discharged from the nozzles 10 by suction purge. Instead of the suction purge, a booster pump, for example, may be used. The booster pump may be disposed in portions of the tubes 15 connecting the sub tank 3 and the ink cartridges 14. Alternatively, the printer may include the booster pump to be connected to an ink cartridge. The booster pump may be driven in a state where the nozzles 10 are covered by the cap 71 to increase the pressure of ink in the inkjet head 4, thereby causing the inkjet head 4 to discharge ink from the nozzles 10 toward the cap 71. The so-called pressurized purging may be performed.

Alternatively, purging may be performed using both of suction by the suction pump 72 and pressurization by the booster pump. Alternatively, instead of purging, flushing may be performed by driving the inkjet head 4 to discharge ink from the nozzles 10.

In the above embodiment, the ejection determination is performed to determine whether the nozzles 10 include a failure nozzle that does not eject ink. In a case where a nozzle 10 ejects ink in an unintended direction, the time for which the ejected ink reaches the detection electrode 91 is long and the potential of the detection electrode 91 changes gently compared to a case where a nozzle 10 ejects ink in an intended direction. From this reason, the ejection determination may be performed to determine whether the nozzles 10 include a failure nozzle that ejects ink in an unintended direction, based on a period of time from when the inkjet head 4 is driven to when the potential outputted from the output 94B exceeds the threshold value VT.

The above embodiment shows, but is not limited to, that, in an ejection determination, the controller 80 determine whether, with respect to each of the nozzles 10 of the inkjet head 4, a nozzle 10 is a failure nozzle based on a signal outputted from the signal output circuit 94 in response to a condition that the inkjet head 4 is driven to eject ink from the nozzle 10. For example, in an ejection determination, the controller 80 may determine, with respect to each of a predetermined number of selected nozzles 10 among the nozzles 10 of the inkjet head 4, a selected nozzle 10 is a failure nozzle in a similar manner. The controller 80 may estimate detection results of remaining nozzles 10 other than the selected nozzles 10 using detection results of the selected nozzles 10 to determine whether a remaining nozzle 10 is a failure nozzle.

The above embodiment shows, but is not limited to, that, in response to receiving a recording instruction, the controller 80 performs the ejection determination before image recording. The controller 80 may perform the ejection determination at a different timing, for example, when a user provides an instruction by operating the operation device 70. In this case, the controller 80 performs processing in accordance with the flowcharts of FIGS. 7 and 8. However, if the nozzles 10 are determined to include no failure nozzle in S104, the process ends immediately after purging in S105.

The disclosure has been applied to a printer including a serial head that moves in the scanning direction together with a carriage. However, the disclosure may also be applied to a printer including, for example, a line head extending over the entire length of a recording sheet P in the scanning direction.

The disclosure has been applied to a printer that ejects ink from nozzles to record an image on a recording sheet P. However, the disclosure may also be applied to another printer that may record an image on a recording medium other than a recording sheet. Examples of the recording media include a T-shirt, a sheet for outdoor advertisement, a casing of a mobile terminal such as a smartphone, a cardboard, and a resin member. Further, the disclosure may also be applied to a liquid ejection apparatus that may eject liquid other than ink such as liquid resin or liquid metal.

What is claimed is:

1. A liquid ejection apparatus comprising:

a liquid ejection head having a plurality of nozzles;

a cap configured to cover the plurality of nozzles;

an electrode accommodated in the cap;

a voltage application circuit configured to apply voltage between the liquid ejection head and the electrode;

a signal output circuit connected to the electrode and configured to output a signal indicating a potential of the electrode; and a controller configured to perform:

causing the voltage application circuit to apply the voltage;

driving the liquid ejection head for causing a certain nozzle to eject liquid toward the cap in a state where the plurality of nozzles face the cap;

receiving the signal from the signal output circuit;

determining, based on the received signal, whether the certain nozzle has ejected liquid normally;

determining, based on the received signal, whether a leakage current has occurred between the certain nozzle and the electrode;

determining, based on a first waveform of the signal, whether the certain nozzle has ejected liquid normally;

determining, based on a second waveform of the signal, whether a leakage current has occurred between the certain nozzle and the electrode; and specifying the certain nozzle as a leakage nozzle if the leakage current has occurred between the certain nozzle and the electrode.

2. The liquid ejection apparatus according to claim 1, wherein the liquid ejection apparatus further comprises a relative movement device configured to cause movement of the liquid ejection head and the cap relative to each other, and wherein the controller is configured to cause the relative movement device to form a capping state in which the cap covers the plurality of nozzles and faces the liquid ejection head.

3. The liquid ejection apparatus according to claim 2, wherein the controller is configured to cause the relative movement device to form an uncapping state in which the cap is spaced from the liquid ejection head in response to determining that the leakage current has occurred.

4. The liquid ejection apparatus according to claim 3, wherein the liquid ejection head has a nozzle surface, the nozzle surface having the plurality of nozzles, wherein the controller is configured to cause the relative movement device to move the liquid ejection head and the cap relative to each other in a certain direction along the nozzle surface, and wherein the controller is configured to perform:

causing the relative movement device to form a first capping state in which the liquid ejection head relative to the cap is located at a first position in the certain direction;

causing the relative movement device to form the uncapping state in response to determining that the leakage current has occurred; and after the uncapping state is formed, causing the relative movement device to form a second capping state in which the liquid ejection head relative to the cap is located at a second position different from the first position in the certain direction.

5. The liquid ejection apparatus according to claim 4, wherein the cap has a lip portion protruding toward the liquid ejection head, the lip portion being disposed around an outer edge of the cap, and wherein a position of the leakage nozzle is farther from the lip portion in the second capping state than a position of the leakage nozzle in the first capping state.

6. The liquid ejection apparatus according to claim 1, wherein the liquid ejection apparatus further comprises a notification device, and wherein the controller is configured to perform:

counting, for each of the plurality of nozzles, a number of times of specification as a leakage nozzle; and transmitting, to the notification device, a notification signal in response to a condition that the number of times of specification as a leakage nozzle for one or more nozzles has reached a predetermined number of times.

7. The liquid ejection apparatus according to claim 1, wherein the liquid ejection apparatus is configured to communicate with an external device, the external device comprising a notification device, and wherein the controller is configured to perform:

counting, for each of the plurality of nozzles, a number of times of specification as a leakage nozzle; and transmitting, to the external device, a notification signal in response to a condition that the number of times of specification as a leakage nozzle for one or more nozzles has reached a predetermined number of times.

8. The liquid ejection apparatus according to claim 1, wherein the cap has a lip portion protruding toward the liquid ejection head, the lip portion being disposed around an outer edge of the cap, wherein the plurality of nozzles include a plurality of proximate nozzles, the plurality of proximate nozzles being located closer to the lip portion than other of the plurality of nozzles at occurrence of the leakage current, and wherein the controller is configured to perform:

after the occurrence of the leakage current, determining whether each of the plurality of proximate nozzles has ejected liquid normally; and specifying the certain nozzle in the plurality of proximate nozzles as the leakage nozzle if the leakage current has occurred between the certain nozzle and the electrode.

9. A liquid ejection apparatus comprising:

a liquid ejection head having a plurality of nozzles;

a cap configured to cover the plurality of nozzles;

an electrode accommodated in the cap;

a voltage application circuit configured to apply voltage between the liquid ejection head and the electrode;

a signal output circuit connected to the electrode and configured to output a signal indicating a potential of the electrode; and a controller configured to perform:

causing the voltage application circuit to apply the voltage;

driving the liquid ejection head for causing a certain nozzle to eject liquid toward the cap in a state where the plurality of nozzles face the cap;

receiving the signal from the signal output circuit;

determining, based on the received signal, whether the certain nozzle has ejected liquid normally;

determining, based on the received signal, whether a leakage current has occurred between the certain nozzle and the electrode;

specifying the certain nozzle as a leakage nozzle if the leakage current has occurred between the certain nozzle and the electrode; and specifying the certain nozzle as a leakage nozzle if the certain nozzle is slated to eject ink immediately before the leakage current occurs and the leakage current has occurred between the certain nozzle and the electrode.

10. A liquid ejection apparatus comprising:

a liquid ejection head having a plurality of nozzles;

a cap configured to cover the plurality of nozzles;

an electrode accommodated in the cap;

a voltage application circuit configured to apply voltage between the liquid ejection head and the electrode;

a signal output circuit connected to the electrode and configured to output a signal indicating a potential of the electrode, wherein the signal output circuit includes:

an amplifying circuit configured to amplify a voltage change at the electrode;

a first output configured to communicate with the electrode via the amplifying circuit, and output a first signal; and a second output configured to communicate with the electrode not via the amplifying circuit, and output a second signal, wherein the signal output circuit is configured to output the signal including the first signal and the second signal, each of the first signal and the second signal indicating a potential of the electrode, the first signal being amplified by the amplifying circuit, the second signal being not amplified by the amplifying circuit; and a controller configured to perform:

causing the voltage application circuit to apply the voltage;

driving the liquid ejection head for causing a certain nozzle to eject liquid toward the cap in a state where the plurality of nozzles face the cap;

receiving the signal from the signal output circuit;

determining, based on the received signal, whether the certain nozzle has ejected liquid normally;

determining, based on the received signal, whether a leakage current has occurred between the certain nozzle and the electrode;

specifying the certain nozzle as a leakage nozzle if the leakage current has occurred between the certain nozzle and the electrode;

determining, based on the first signal, whether the certain nozzle has ejected liquid normally; and determining, based on the second signal, whether a leakage current has occurred between the certain nozzle and the electrode.

11. A liquid ejection apparatus comprising:

a liquid ejection head having a plurality of nozzles;

a cap configured to cover the plurality of nozzles;

an electrode accommodated in the cap;

a voltage application circuit configured to apply voltage between the liquid ejection head and the electrode;

a signal output circuit connected to the electrode and configured to output a signal indicating a potential of the electrode;

a discharging circuit; and a controller configured to perform:

causing the voltage application circuit to apply the voltage;

driving the liquid ejection head for causing a certain nozzle to eject liquid toward the cap in a state where the plurality of nozzles face the cap;

receiving the signal from the signal output circuit;

determining, based on the received signal, whether the certain nozzle has ejected liquid normally;

determining, based on the received signal, whether a leakage current has occurred between the certain nozzle and the electrode;

specifying the certain nozzle as a leakage nozzle if the leakage current has occurred between the certain nozzle and the electrode; and causing the discharging circuit to discharge in response to determining that the leakage current has occurred between the certain nozzle and the electrode.

* * * * *